United States Patent [19]

Tanimoto et al.

[11] Patent Number: 5,013,490

[45] Date of Patent: May 7, 1991

[54] DEVICE FOR RELEASING AND DIFFUSING BUBBLES INTO LIQUID

[75] Inventors: Shigemi Tanimoto; Yoshiaki Eguchi, both of Osaka, Japan

[73] Assignee: Showa Aluminum Corporation, Osaka, Japan

[21] Appl. No.: 423,304

[22] Filed: Oct. 18, 1989

[30] Foreign Application Priority Data

Oct. 21, 1988 [JP] Japan ..... 63-266673
Oct. 21, 1988 [JP] Japan ..... 63-266674

[51] Int. Cl.[5] ..... B01F 3/04
[52] U.S. Cl. ..... 261/87
[58] Field of Search ..... 261/87

[56] References Cited

U.S. PATENT DOCUMENTS

| | | | |
|---|---|---|---|
| 2,713,477 | 7/1955 | Daman | 261/87 |
| 2,743,914 | 5/1956 | Epprecht | 261/87 |
| 3,121,651 | 3/1964 | Gross et al. | 261/87 |
| 3,212,759 | 10/1965 | Brown | 261/87 |
| 3,650,513 | 3/1972 | Wemer | 261/87 |
| 4,426,068 | 1/1984 | Gimond et al. | 266/225 |
| 4,611,790 | 9/1986 | Otsuka et al. | 261/87 |

FOREIGN PATENT DOCUMENTS

| | | | |
|---|---|---|---|
| 1158406 | 1/1958 | France | 261/87 |
| 1191428 | 11/1985 | U.S.S.R. | 261/87 |

*Primary Examiner*—Tim Miles
*Attorney, Agent, or Firm*—Armstrong, Nikaido, Marmelstein, Kubovcik, & Murray

[57] ABSTRACT

The device of the present invention includes a rotary shaft to be disposed in a liquid approximately vertically and rotatable about its axis. The rotary shaft has a gas channel axially extending therethrough. A bubble releasing-diffusing rotor is fixedly attached to the lower end of the rotary shaft and has a plurality of liquid agitating projections formed along its periphery at a specified spacing circumferentially thereof. The rotor is formed in its bottom face with a plurality of grooves extending radially from the central portion of the bottom face to the outer ends of the respective liquid agitating projections for centrifugally guiding the liquid when the rotary shaft is in rotation. The rotor has gas discharge ports communicating with the gas channel of the rotary shaft via a communication passage and equal in number to the number of the grooves for discharging the gas therefrom so that bubbles are entrained in the liquid centrifugally flowing out from the outer ends of the grooves in the peripheral surface of the rotor.

12 Claims, 5 Drawing Sheets

DEVICE FOR RELEASING AND DIFFUSING BUBBLES INTO LIQUID

BACKGROUND OF THE INVENTION

The present invention relates to devices for releasing a gas into a liquid in a container in the form of finely divided bubbles and diffusing the bubbles through the entire body of liquid.

The term "inert gas" as used herein includes nitrogen gas which is inert to aluminum and aluminum alloys, in addition to argon gas, helium gas, krypton gas and xenon gas in the Periodic Table.

There are cases wherein a gas needs to be released as finely divided into a liquid. For example, a treating gas is released in the form of bubbles into molten aluminum or aluminum alloy to remove from the melt dissolved hydrogen gas, nonmetallic inclusions in the form of oxides of aluminum, magnesium and like metals, or potassium, sodium, phosphorus and like metals. Further to promote a chemical reaction, a gas is released in the form of bubbles into a liquid and thereby brought into contact with the liquid. To contact the gas with the liquid effectively in these cases, it is required to divide the gas as finely as possible and diffuse the resulting bubbles through the liquid uniformly.

Heretofore used for this purpose is a device which comprises a vertical rotary shaft having a gas channel extending through the shaft longitudinally thereof, and a bubble releasing-diffusing rotor attached to the lower end of the shaft. The rotor has a plurality of liquid agitating blades formed on its peripheral surface and arranged at a specified spacing circumferentially thereof. Gas discharged ports are formed in the peripheral surface each between the immediately adjacent blades and communicating with the gas channel of the rotary shaft. A plurality of liquid channels extends from the bottom face of the rotor to the respective gas discharge ports. With this device, the vertical rotary shaft is rotated while supplying to the gas channel the gas to be released into a liquid to thereby release the gas from the discharge ports in the form of bubbles. At this time, the liquid flows into the liquid channels via their openings in the bottom of the rotor, then passes through these channels toward the gas discharge ports in the rotor peripheral surface and thereafter flows out from the ports, whereby the bubbles released from the discharge ports are diffused through the entire body of liquid and further divided finely.

The conventional device, however, has a problem. When the rotor is rotated, the liquid in the container also flows in the direction of rotation of the rotor at a velocity lower than the peripheral velocity of the rotor. At this time, the greater the difference between the flow velocity of the liquid and the peripheral velocity of the rotor, the greater is the effect to finely divide the bubbles. The above device does not have a great velocity difference since each gas discharge port is formed in the recessed peripheral portion of the rotor between the adjacent blades. Moreover, when the amount of gas to be released increases, the recessed peripheral portion of the rotor becomes filled with the gas, making it difficult to finely divided the bubbles, to fully agitate the liquid and to diffuse the bubbles into the liquid effectively. The bottom of the rotor has a flat surface and therefore, it is difficult for the liquid to flow into the liquid channels. Each of the liquid channels, which has a completely closed periphery in cross section, offers great resistance to the liquid flowing into the channel, consequently giving a reduced velocity to the liquid when it flows out from the gas discharge port. These difficulties or drawbacks impose limitations on the effect of the liquid to finely divide and diffuse bubbles when the liquid flows out of the rotor.

FIGS. 10 and 11 show another known bubble releasing-diffusing device which comprises a vertical rotary shaft 70 to be disposed in a liquid and having a gas channel 71 extending through the shaft longitudinally thereof. A bubble releasing-diffusing rotor 72 is provided at the lower end of the shaft 70. The rotor 72 has a plurality of liquid agitating projections 73 formed at its periphery and arranged at a specified spacing circumferentially thereof. A gas outlet 74 is formed in the bottom of the rotor centrally thereof in communication with the gas channel 71. A plurality of grooves 75 is formed in the bottom face of the rotor 72, extending radially from the gas outlet 74 to the outer surfaces of the respective projections 73 and each having an open outer end in the peripheral surface of the rotor 72. With this device, the rotary shaft 70 is rotated while supplying to the gas channel 71 the gas to be released into the liquid, whereby the gas is fed from the gas outlet 74 to the bottom face of the rotor 72. The gas then flows through the grooves 75 toward the periphery of the rotor 72, where the gas comes into contact with the peripheral edges of the rotor 72 defining the openings of the grooves 75, whereupon the gas is finely divided and released.

The conventional device described above will finely divide and diffuse the gas when the amount of supply of the gas is small, however when the gas supply increases, the following problem arises with the conventional device. When the gas is fed through the gas channel 71 to the gas outlet 74 in the center of bottom face of the rotor 72, a portion of the gas G collects around the gas outlet 74 in the bottom of the rotor 72 as shown in FIGS. 10 and 11 due to the pressure of the liquid. In almost all cases, the bottom face of the rotor 72 is not perfectly horizontal but somewhat inclined, so that the gas portion G can not enter the grooves 7 wholly but overflows from the grooves 75, rises along the inclination of the bottom face and is released from the upper end of the inclined bottom face collectively in the form of large bubbles. Moreover, since the bubbles themselves are small in weight, only a small centrifugal force acts on the bubbles, which therefore move toward the peripheral edge of the bottom of the rotaor 72 at a low velocity. Consequently, the gas can not be finely divided and diffused effectively.

SUMMARY OF THE INVENTION

The main object of the present invention is to overcome the foregoing problems and to provide a device for finely dividing a diffusing bubbles more effectively than the conventional devices.

The device of the present invention comprises a rotary shaft to be disposed in a liquid approximately vertically and rotatable about its axis. The rotary shaft has a gas channel axially extending therethrough. A bubble releasing-diffusing rotor is fixedly attached to the lower end of the rotary shaft and has a plurality of liquid agitating projections formed along its periphery at a specified spacing circumferentially thereof. The rotor is formed in its bottom face with a plurality of grooves extending radially from the central portion of the bottom face to the outer ends of the respective liquid agitating projections for centrifugally guiding the liquid when the rotary shaft is in rotation. The rotor has gas discharge ports communicating with the gas channel of the rotary shaft via a communication passage and equal in number to the number of the grooves for discharging the gas therefrom so that bubbles are entrained in the liquid centrifugally flowing out from the outer ends of the grooves in the peripheral surface of the rotor.

When the rotary shaft is rotated with the device immersed in a liquid while supplying to the gas channel of the rotary shaft the gas to be released into the liquid, the liquid passes through the groove radially outwardly of the rotor and flows out from the outer ends of the liquid agitating projections. The gas supplied to the gas channel dividedly flows toward the gas discharge ports and is released into the body of liquid from the discharge ports in the form of bubbles as entrained in the outgoing flows of liquid. The bubbles are finely divided by the flowing liquid and released. Moreover, the bubbles released into the liquid as entrained in the outgoing liquid are diffused through the entire body of liquid and further divided more finely. Even if the amount of gas supplied to the gas channel of the rotary shaft increases, the effect to finely divide and diffuse the bubbles will not be impaired but a large quantity of gas can be brought into contact with the liquid at a time. Accordingly, it is possible to treat a large amount of molten metal at a time for the removal of hydrogen gas and nonmetallic inclusions therefrom or to effect a chemical reaction between large quantities of liquid and gas to achieve a high removal or reaction efficiency.

The present invention will be described in greater detail with reference to FIGS. 1 to 9.

DESCRIPTION OF THE PREFERRED EMBODIMENTS

Figure 1:
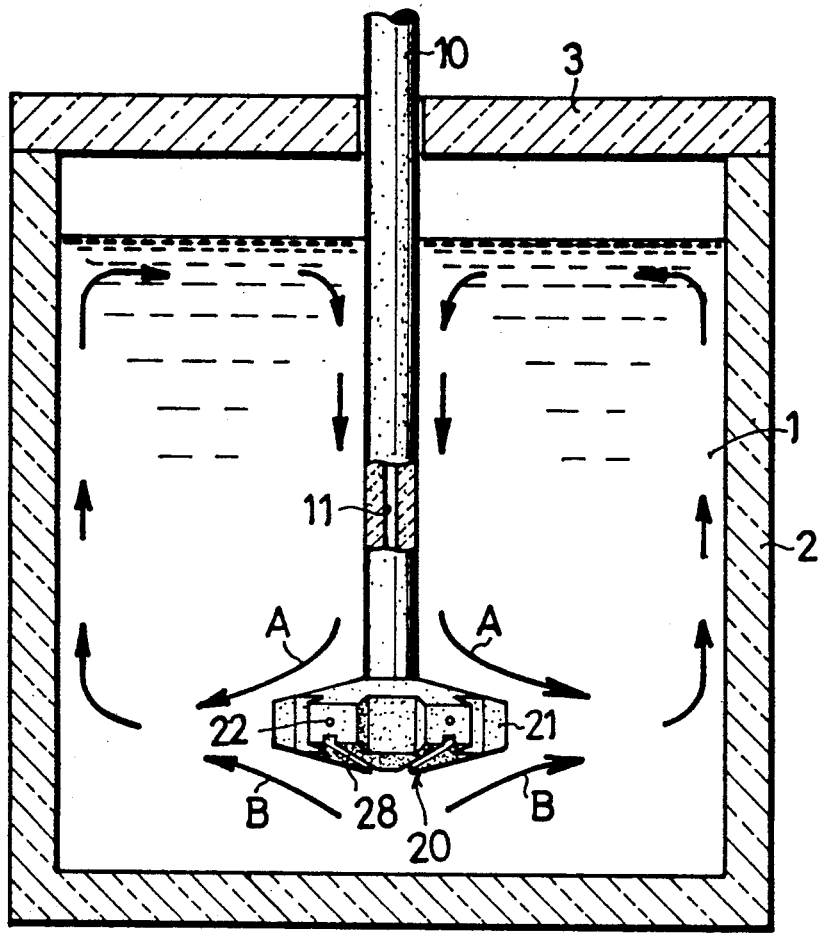
FIG. 1 is a front view showing a first embodiment of the invention, a container being shown in section and the other portion being partly broken away.

Throughout the drawings, like parts are designated by like reference numerals.

Figure 2:
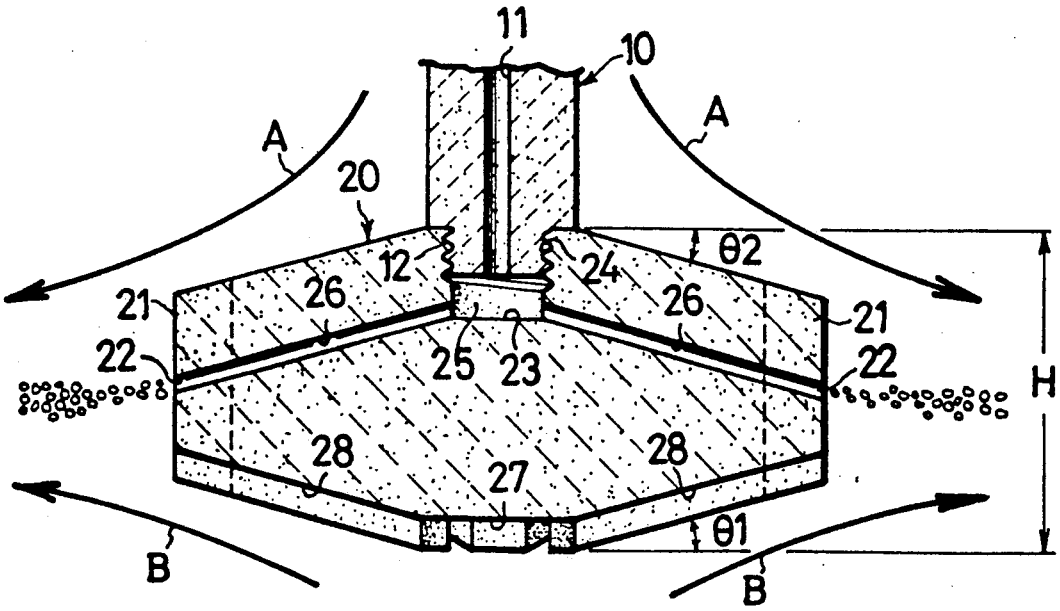
FIG. 2 is an enlarged fragmentary view in vertical section of the same.
Figure 3:
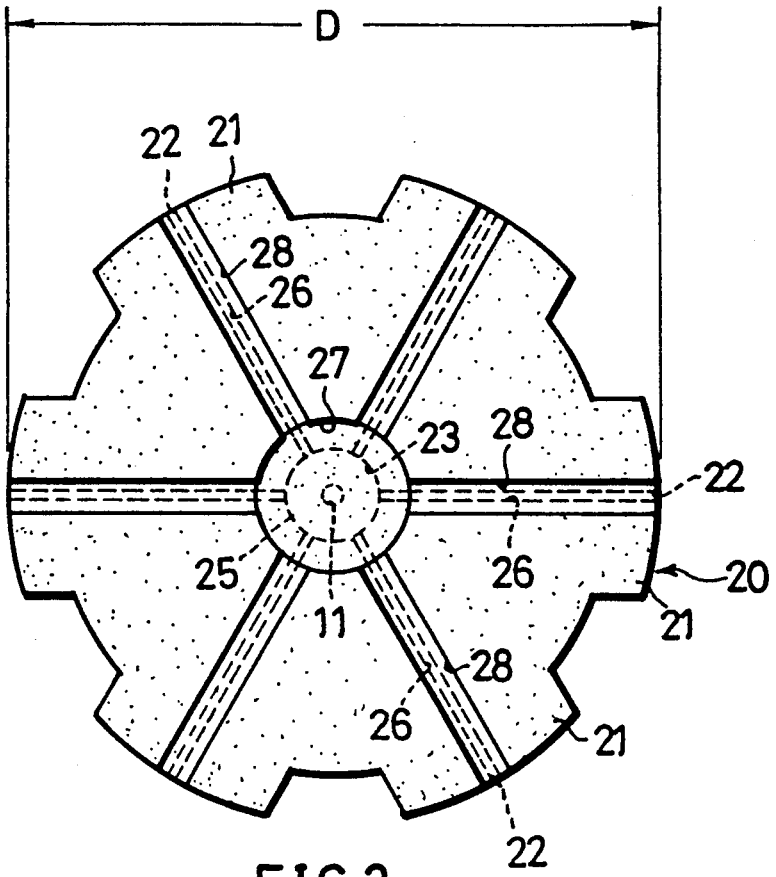
FIG. 3 shows the first embodiment like FIG. 1 and is a bottom view of a rotor.

FIGS. 1 to 3 show a device as a first embodiment of the invention. The device comprises a tubular rotary shaft 10 having a gas channel 11 extending axially therethrough and disposed vertically in a container 2, and a bubble dividing-diffusing rotor 20 in the form of a disk and fixed to the lower end of the rotary shaft 10. The container 2 is, for example, a rectangular parallelepipedal or cubic tank for accommodating therein a liquid 1 such as molten aluminum or aluminum alloy, or a liquid for use in a gas-liquid contact process.

The rotary shaft 10 extends upward through a closure 3 of the container 2 and is rotatable by an unillustrated known drive device disposed above the container 2. The lower end of the shaft 10 is positioned in the vicinity of the bottom of the container 2 and externally threaded as at 12. The upper end of the gas channel 11 is in communication with an unillustrated known gas supply device. When the present device is used for removing hydrogen gas and nonmetallic inclusions from molten aluminum or aluminum alloy, the gas supply device supplies an inert gas, chlorine gas or a mixture of inert gas and chlorine gas. Alternatively when the present device is used for removing alkali metals from molten aluminum or aluminum alloy, the gas supply device supplies chlorine gas or a mixture of chlorine gas and insert gas.

The rotor 20 has a peripheral surface of a predetermined height and is provided on its periphery with a plurality of, preferably at least three, liquid agitating projections 21 formed over the entire height of the peripheral surface and arranged at a specified spacing circumferentially thereof. A circular gas discharge port 22 communicating with the gas channel 11 of the rotary shaft 10 is formed in the outer surface of each agitating projection 21. The top surface of the rotor 20 is gradually inclined downward from its center toward the peripheral edge thereof and is therefore upwardly tapered. A recessed portion 23 is formed in the top of the rotor 20 centrally thereof. The approximate upper half of the periphery of the recessed portion 23 is internally threaded as at 24. The externally threaded lower end portion 12 of the rotary shaft 10 is screwed in the internally threaded portion 24, whereby the rotor 20 is fixed to the shaft 10. With the rotor 20 fixed to the shaft 10, the remainder of the recessed portion 23 serves as a gas chamber 25. The rotor 20 is formed with a plurality of radial passageways 26 extending from the gas chamber 25 to the outer ends of the respective agitating projections 21. The outer end of the passageway 26 is the gas discharge port 22. The bottom face of the rotor 20 is gradually slanted upward from its center toward the peripheral edge thereof and is thus tapered downward. Preferably, the angle of inclination, $\theta 1$, of the bottom surface of the rotor 20 is approximately equal to the angle of inclination, $\theta 2$, of the top surface thereof. The angle of inclination, $\theta 1$, which is approximately equal to the angle of inclination, $\theta 2$, includes an angle of inclination, $\theta 1$, of the bottom surface which is about 2 to 3 degrees greater than the angle of inclination, $\theta 2$, of the top surface. The inclination angles $\theta 1$ and $\theta 2$ of the bottom and top surfaces of the rotor 20 are determined suitably by experiments in view of the size of the container 2 for the liquid, the kind of liquid, etc. and are preferably about 5 to about 40 degrees. A liquid inlet cavity 27 is formed in the bottom surface of the rotor 20 centrally thereof. Also formed in the bottom surface of the rotor 20 are a plurality of radial grooves 28 extending from the inlet cavity 27 to the peripheral edge of the bottom surface and each having an open end in the outer end of the agitating projection 21 at the periphery of the rotor. The open ends of the radial grooves 28 in the rotor peripheral surface are positioned immediately below the respective gas discharge ports 22.

The greater the diameter or the peripheral velocity of the rotor 10, the greater is the effect to finely divide bubbles. The diameter and the peripheral velocity are determined suitably by experiments in view of the size of the liquid container 2, the kind of liquid, etc. The size of the gas discharge ports 22, the cross sectional area of the grooves 28, and the size and number of the agitating projections 21 are also suitably determined by experiments in view of the size of the liquid container, the kind of liquid, etc. We have found that the smaller the gas discharge ports 22, the better is the result achieved. When the ports are circular, the diameter thereof is preferably about 0.5 to about 7 mm.

It is desired that the outer surface of the rotary shaft 10, as well as of the rotor 20, be covered with a material inert to the liquid, and that the inner surface of the gas channel 11 of the rotary shaft 10 and the inner surface of each passageway 26 holding the gas channel 11 of the shaft 10 in communication with the gas discharge port 22 be covered with a material inert to the gas. For example, when the liquid is molten metal such as aluminum or aluminum alloy, the device is entirely made of a ceramic material inert to the metal, such as graphite, silicon nitride, silicon carbide, alumina, carbon ceramic or the like. The gas to be released and deffused into the liquid is preferably an inert gas, chlorine gas or a mixture of chlorine gas and inert gas when hydrogen gas and nonmetallic inclusions are to be removed from molten aluminum or aluminum alloy, or is chlorine gas or mixture of chlorine gas and inert gas when alkali metals are to be removed from the molten metal.

The device described above is placed into the liquid to be treated, and the rotary shaft 10 is rotated about its axis at a high speed by the drive device while supplying from the gas supply device to the gas channel 11 the gas to be forced into the liquid. The gas enters the gas chamber 25 from the lower end of the gas channel 11, dividedly flows into the passageways 26, passes throught the passageways 26 and is forced out from the gas discharge ports 12 in the periphery of the rotor 20, i.e., in the outer end faces of the agitating projections 21. The gas is finely divided into bubbles upon striking on the port (22) defining edge of each projection 21 and is released. Since the peripheral velocity of the rotor 20 is greater at the outer end of the projection 21 than at the portion between the adjacent projections 21, the difference between the peripheral velocity and the flow velocity of the liquid is great to result in an enhanced gas shearing action, whereby the bubbles are finely divided before release.

On the other hand, the liquid above the rotor 20 flows along the tapered top surface of the rotor 20 as indicated by arrows A in FIGS. 1 and 2. The liquid below the rotor 20 flows into the inlet cavity 27, passes through the grooves 28 and is released from the outer open ends of the grooves 28 as indicated by arrows B in FIGS. 1 and 2. The two streams indicated by the arrows A and B join together at a position a predetermined distance away from the periphery of the rotor 20 and further advance toward the centrifugal direction. The finely divided bubbles released from each discharge port 22 advance centrifugally as entrained in the two streams of liquid indicated by the arrows A and B and are diffused throught the entire body of liquid. At this time, the bubbles are further divided finely by the streams of liquid. Since the liquid flows centrifugally while revolving in the same direction as the direction of rotation of the rotor 20 due to the agitation by the projections 21, the bubbles are diffused through the liquid also by this flow of liquid.

Because the grooves 28 are open downward, the resistance offered to the liquid through the grooves 28 is smaller than in the liquid channels in the former of the two prior-art devices already described. Accordingly, the present device more effectively finely divides bubbles and diffuses the bubbles.

When hydrogen gas and nonmetallic inclusions are to be removed from molten aluminum or aluminum alloy, they are removed by the same method as disclosed in the specification of U.S. Pat. No. 4,611,790.

Figure 4:
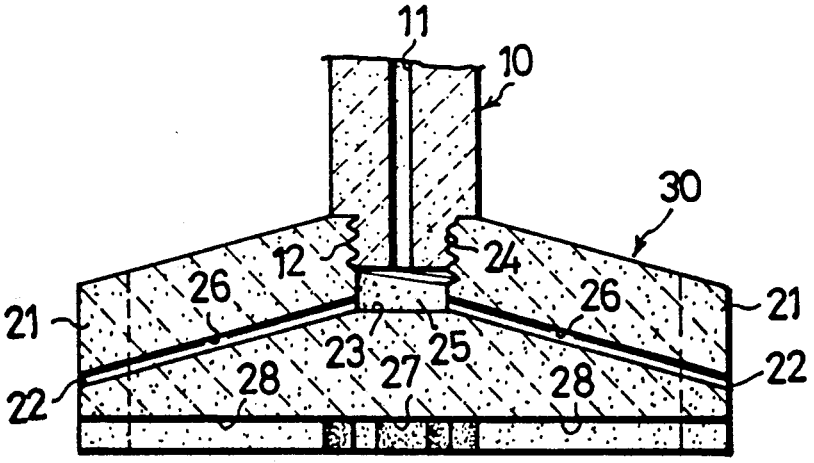
FIG. 4 is a view in vertical section corresponding to FIG. 2 and shows a second embodiment of the invention.

With reference to FIG. 4 showing a second embodiment of the invention, a rotor 30 fixed to the lower end of the rotary shaft 10 has a flat bottom surface. With this structure as in the case of the first embodiment, the gas is released into the liquid as finely divided in the form of bubbles and diffused through the whole liquid.

Figure 5:
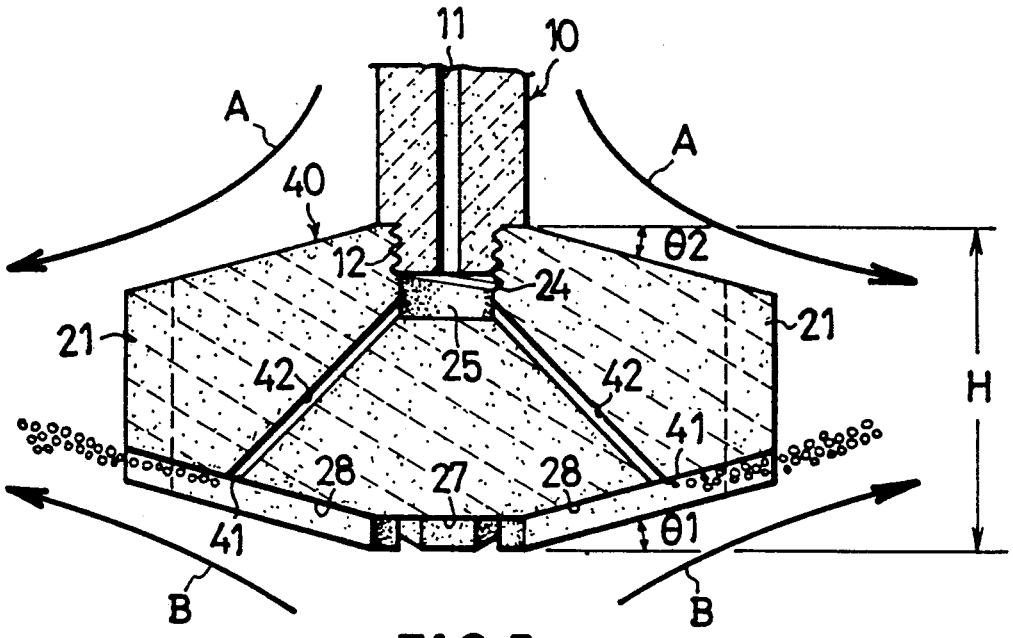
FIG. 5 is a view in vertical section corresponding to FIG. 2 and shows a third embodiment of the invention.
Figure 6:
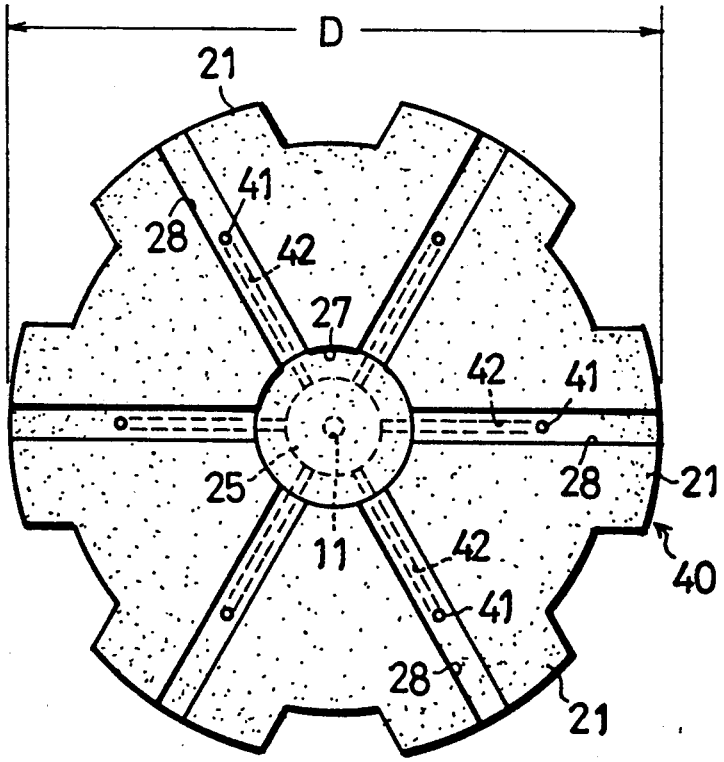
FIG. 6 shows the third embodiment like FIG. 5 and is a bottom view of a rotor.

With reference to FIGS. 5 and 6 showing a third embodiment of the present invention, each groove 28 in a rotor 40 is formed, in the bottom of a lengthwise intermediate portion thereof, with a circular gas discharge port 41 in communication with the gas channel 11 of the rotary shaft 10 via a passageway 42. We have found that the smaller the port 41, the better as in the first embodiment. When circular, the discharge port 41 is preferably about 0.5 to about 7 mm in diameter.

The device described is placed into the liquid to be treated, and the rotary shaft 10 is rotated about its axis at a high speed by the drive device while supplying from the gas supply device to the gas channel 11 the gas to be introduced into the liquid, whereupon the gas flows out from the lower end of the gas channel 11 into the gas chamber 25 and then into the passageways 42 and is forced out from the gas discharge ports 41 into the grooves 28. The gas is forced against the port (41) defining edge of each grooved portion 28 by the liquid flowing therethrough, finely divided into bubbles and released into the groove 28. The bubbles are transported centrifugally as entrained in the flow of liquid through the groove 28 and released from the outer end of the groove 28 into the liquid. At this time, the bubbles are further finely divided by the edge around the open end of the groove 28. Consequently, finely divided bubbles are diffused through the entire body of liquid in the same manner as in the first embodiment.

Figure 7:
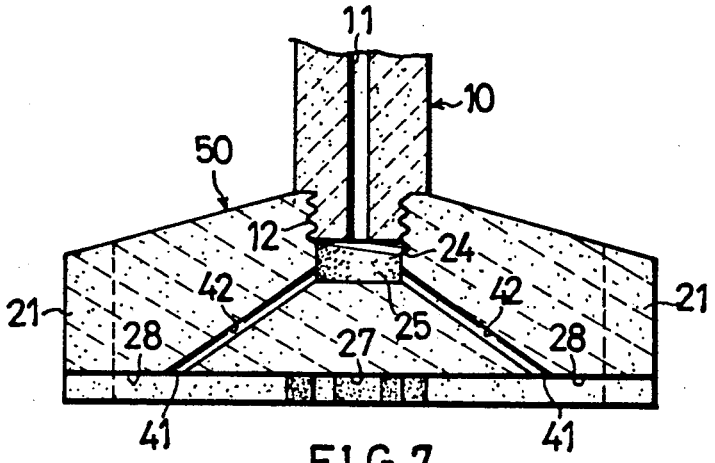
FIG. 7 is a view in vertical section corresponding to FIG. 2 and shows a fourth embodiment of the invention.

With reference to FIG. 7 showing a fourth embodiment of the invention, a rotor 50 fixed to the lower end of the rotary shaft 10 has a flat bottom surface. With this device as in the third embodiment, the gas is released into the liquid as finely divided in the form of bubbles, which are then diffused through the entire body of liquid.

EXAMPLE 1

The device shown in FIGS. 1 to 3 was used in this example to check the bubbles produced for fineness and state of diffusion. Water was placed into a rectangular parallelepipedal container 2 transparent acrylic resin, 800 mm in length, 800 mm in width and 750 mm in height, to a depth of 600 mm. The rotor 20 was 200 mm in diameter (from the outer end of projection 21 to the outer end of another projection diametrically opposed thereto) D, 70 mm in height H, 6 in the number of agitating projections 21, 6 in the number of gas discharge ports 22, 15 degrees in the inclination angle $\eta 2$ of the top surface, 15 degrees in the inclination angle $\theta 1$ of the bottom surface, 4 mm in the diameter of the gas discharge ports 22, 8 mm in the width of the grooves 28 in the bottom surface, and 8 mm in the depth of the grooves 28. Ar gas was supplied to the gas channel 11 from a gas supply device at a rate of 30 liters/min, 60 liters/min, 120 liters/min or 200 liters/min. The bubbles diffused through the water were checked for size and the state of diffusion in the water. The table below shows the results.

EXAMPLE 2

Ar gas was introduced into water in the same manner as in Example 1 with the exception of using the device of FIGS. 5 and 6 wherein the rotor 40 was 200 mm in diameter (the same as above) D, 70 mm in height H, 6 in the number of agitating projections 21, 6 in the number of gas discharge ports 41, 15 degrees in the inclination angle $\theta 2$ of the top surface, 15 degrees in the inclination angle $\theta 1$ of the bottom surface, 4 mm in the diameter of the gas discharge ports 41, 8 mm in the width of the grooves 28 in the bottom surface, and 8 mm in the depth of the grooves 28. The bubbles diffused through the water were checked for size and the state of diffusion in the water. The table below shows the results.

COMPARATIVE EXAMPLE

Figure 10:
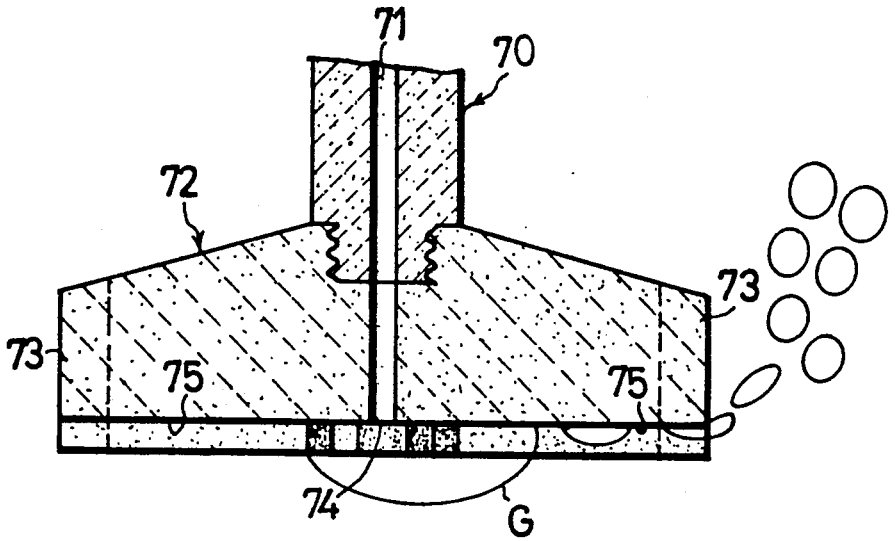
FIG.10 Prior art
FIG. 10 is a view in vertical section corresponding to FIG. 2 and shows a conventional device.
Figure 11:
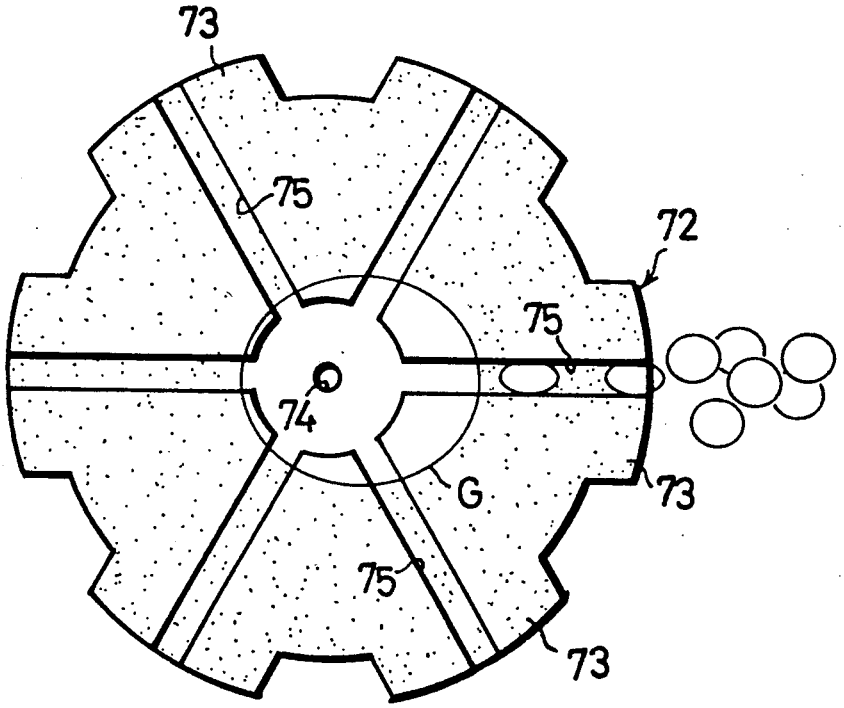
FIG.11 Prior art
FIG. 11 is a bottom view showing the same.

The conventional device shown in FIGS. 10 and 11 was used in this comparative example to check the bubbles produced for fineness and state of diffusion. More specifically, the bubbles diffused through water were checked for size and the state of diffusion in the water in the same manner as in Example 1 except that the rotor 72 used was 200 mm in diameter, 70 mm in height, 6 in the number of grooves 75 in the bottom, 6 in the number of projections 73 on the periphery, 15 degrees in the inclination angle of the top surface, 8 mm in the width of the grooves 75 and 8 mm in the depth of the grooves 75. The table below shows the results.

| Ar flow rate | 30 liters/min | | 60 liters/min | | 120 liters/min | | 200 liters/min | |
|---|---|---|---|---|---|---|---|---|
| Item checked | Bubble size* | Diffused state | Bubble size | Diffused state | Bubble size | Diffused state | Bubble size | Diffused state |
| Example 1 | 0.5–2 | Good | 0.5–2 | Good | 1–3 | Good | 1–3 | Good |
| Example 2 | 0.5–2 | Good | 0.5–2 | Good | 1–3 | Good | 1–3 | Good |
| Comp. Ex. | 0.5–2 | Good | 1–3 | Good | 5–20 | ** | 5–20 | ** |

*the bubble size given is the diameter of bubbles in mm.
**Bubbles collected around the rotary shaft and did not spread.

The table reveals that when the supply of gas is small, the devices of both the invention and the prior art exhibit an excellent effect to finely divide and diffuse the gas but that at increased rates of supply of gas, the devices of Examples 1 and 2 are superior in the effect to finely divide and diffuse bubbles.

EXAMPLE 3

Figure 8:
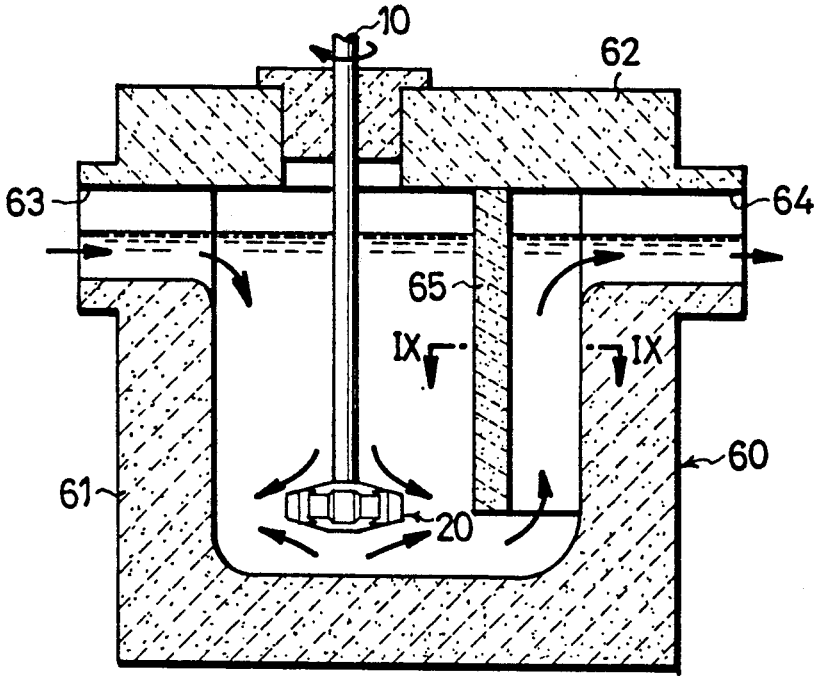
FIG. 8 is a front view showing the first embodiment as it is used in an apparatus for treating molten aluminum or aluminum alloy, a melt treating container shown as partly broken away.
Figure 9:
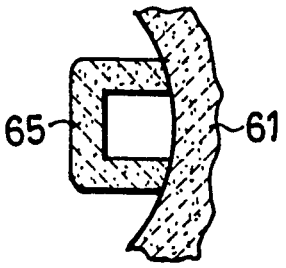
FIG. 9 is an enlarged view in section taken along the line IX—IX in FIG. 8.

In this example, the device of the invention was used for removing hydrogen gas from molten aluminum alloy. FIGS. 8 and 9 show a hydrogen gas removing apparatus which includes a molten aluminum alloy treating container 60 comprising a body 61 having an open upper end, and a removable closure 62 closing the open upper end of the body 61. The body 61 is provided at its upper end portion with a melt inlet 63 and a melt outlet 64. At a position opposed to the melt outlet 64, a partition wall 65, U-shaped in horizontal section, extends downward from the lower surface of the closure 62 to cover the inner end portion of the melt outlet 64 and the inner surface portion of the body 61 extending downward from the outlet portion. The lower end of the partition wall 65 is positioned close to the bottom wall of the body 61. The bubble releasing-diffusing device is disposed in the container 60 with its rotary shaft 10 extending through the closure 62. With the treating apparatus, molten aluminum alloy flows into the container 60 through the melt inlet 63, descends the portion surrounded by the partition wall 65 and flows out of the apparatus via the melt outlet 64. During the passage through the container 60, the melt is treated by the bubble releasing-diffusing device for the removal of hydrogen gas therefrom.

The bubble releasing-diffusing device used in Example 1 was used. While passing molten AA6063 alloy through the treating container 60 at a rate of 9 tons/-hour and rotating the rotary shaft 10 at a speed of 700 r.p.m., Ar gas was supplied to the gas channel 11 at a rate of 80 liters/min to remove hydrogen gas from the molten aluminum alloy flowing through the container 60.

The hydrogen gas content of the molten aluminum alloy flowing into the container 60 via the inlet 63 and the hydrogen gas content of the melt flowing out from the outlet 64 were found to be 0.43 to 0.46 c.c./ 100 g Al and 0.07 to 0.10 c.c./100 g Al, respectively, as measured by TELEGAS device.

EXAMPLE 4

The device used in Example 2 was employed in this example for removing hydrogen gas from molten AA6063 aluminum alloy in the same manner as in Example 3.

The hydrogen gas content of the molten aluminum alloy entering the container 60 through the inlet 63 and that of the melt flowing out from the outlet were found to be 0.43 to 0.46 c.c./100 g Al and 0.07 to 0.10 c.c./100 g Al, respectively, when measured by the TELEGAS device.

The device of the present invention is used not only for removing hydrogen gas, nonmetallic inclusions or alkali metals from molten aluminum or aluminum alloys but is usable in gas-liquid contact processes to effect an accelerated chemical reaction and also for other purposes.

The present invention may be embodied differently without departing from the spirit and basic features of the invention. Accordingly, the embodiments herein disclosed are given for illustrative purposes only and are in no way limitative. It is to be understood that the scope of the invention is defined by the appended claims rather than by the specification and that all alterations and modifications within the definition and scope of the claims are included in the claims.

What is claimed is:

1. A bubble releasing-diffusing device for releasing a gas into a liquid in a form of finely divided bubbles and diffusing the bubbles through an entire body of liquid, the device comprising:

a rotary shaft to be disposed in the liquid approximately vertically and rotatable about an axis, the rotary shaft having a gas channel axially extending therethrough;

a bubble releasing-diffusing rotor having a recessed portion into which a lower end of the rotary shaft is partially threaded and inserted to form a gas chamber therein which is smaller in size than the lower end of said rotary shaft and said rotor having a plurality of liquid agitating projections formed along a periphery at a specified spacing circumferentially thereof, the rotor formed in a bottom face with a plurality of grooves extending radially from a central portion of the bottom face to outer ends of respective liquid agitating projections for centrifugally guiding the liquid when the rotary shaft is in rotation; and gas discharge ports of the rotor communicating with the gas channel of the rotary shaft via inclined communication passages connected to said gas chamber and equal in number to the number of the grooves for discharging the gas therefrom so that bubbles are entrained in the liquid centrifugally flowing out from outer ends of the grooves in a peripheral surface of the rotor.

2. A device as defined in claim 1 wherein the gas discharge port is formed in a bottom of each groove at a lengthwise intermediate portion thereof.

3. A device as defined in claim 1 wherein the gas discharge port is formed in the outer end of each of the liquid agitating projections.

4. A device as defined in claim 1 wherein the gas discharge port is circular and 0.5 to 7 mm in diameter.

5. A device as defined in claim 1 wherein the bottom face of the rotor is inclined upward from the central portion toward a peripheral edge thereof.

6. A device as defined in claim 5 wherein the bottom face of the rotor has an angle of inclination of 5 to 40 degrees.

7. A device as defined in claim 5 wherein a top surface of the rotor is downwardly inclined from a central portion toward a peripheral edge thereof.

8. A device as defined in claim 7 wherein the top surface of the rotor has an angle of inclination of 5 to 40 degrees.

9. A device as defined in claim 7 wherein the angle of inclination of the bottom face of the rotor is equal to the angle of inclination of the top surface thereof.

10. A device as defined in claim 1 wherein a cavity is formed in the bottom face of the rotor, and each of the grooves has a radially inward end opened to the cavity.

11. A device as defined in claim 1 wherein outer surfaces of the rotary shaft and the rotor are covered with a material inert to the liquid.

12. A device as defined in claim 1 wherein an inner surface of the gas channel of the rotary shaft and an inner surface of each communication passage holding the gas channel in communication with each gas discharge port are covered with a material inert to the gas.

* * * * *